US007942569B2

(12) United States Patent
Orben et al.

(10) Patent No.: US 7,942,569 B2
(45) Date of Patent: May 17, 2011

(54) METERING SYSTEM FOR PREPARING EMULSION PAINTS FROM MULTIPLE AQUEOUS PAINT COMPONENTS

(75) Inventors: Rainer Orben, Sponheim (DE); Joerg Rueger, Kleinostheim (DE)

(73) Assignee: Schulz GmbH Farben-und Lackfabrik, Langenlonsheim (DE)

( * ) Notice: Subject to any disclaimer, the term of this patent is extended or adjusted under 35 U.S.C. 154(b) by 1088 days.

(21) Appl. No.: 10/582,433

(22) PCT Filed: Oct. 15, 2004

(86) PCT No.: PCT/EP2004/011604

§ 371 (c)(1),
(2), (4) Date: Mar. 12, 2007

(87) PCT Pub. No.: WO2005/061085

PCT Pub. Date: Jul. 7, 2005

(65) Prior Publication Data

US 2007/0253280 A1 Nov. 1, 2007

(30) Foreign Application Priority Data

Dec. 11, 2003 (DE) ..... 103 57 861

(51) Int. Cl.
*B01F 15/04* (2006.01)

(52) U.S. Cl. ..... 366/141; 366/160.2; 366/208

(58) Field of Classification Search ..... 366/141, 366/152.1, 152.2, 160.1–160.5, 181.6, 208–209
See application file for complete search history.

(56) References Cited

U.S. PATENT DOCUMENTS

| | | | | |
|---|---|---|---|---|
| 4,335,759 | A * | 6/1982 | Pattiniemi et al. | 141/5 |
| 4,403,866 | A * | 9/1983 | Falcoff et al. | 366/132 |
| 5,493,840 | A * | 2/1996 | Cane | 53/50 |
| 6,510,366 | B1 * | 1/2003 | Murray et al. | 700/239 |
| 6,793,387 | B1 * | 9/2004 | Neas et al. | 366/160.4 |
| 6,969,190 | B1 | 11/2005 | McClain et al. | |
| 7,065,429 | B1 * | 6/2006 | McClain et al. | 700/239 |
| 2003/0080140 | A1 * | 5/2003 | Neas et al. | 222/1 |
| 2007/0253280 | A1 * | 11/2007 | Orben et al. | 366/141 |

FOREIGN PATENT DOCUMENTS

| | | | |
|---|---|---|---|
| DE | 196 54 829 | | 6/1998 |
| DE | 101 14 060 | | 1/2002 |
| EP | 0 461 371 | A1 | 12/1991 |
| EP | 1 138 374 | | 10/2001 |
| WO | WO 97/46308 | | 12/1997 |
| WO | WO 98/28069 | | 7/1998 |
| WO | WO 00/68137 | | 11/2000 |
| WO | WO 02/074644 | A1 | 9/2002 |
| WO | WO 02/083282 | A1 | 10/2002 |
| WO | WO 03/090914 | A2 | 11/2003 |

OTHER PUBLICATIONS

International Search Report dated Jan. 27, 2005 (3 pages).

* cited by examiner

*Primary Examiner* — Charles E Cooley
(74) *Attorney, Agent, or Firm* — Flynn, Thiel, Boutell & Tanis, P.C.

(57) ABSTRACT

The invention relates to a dosing arrangement which is used to mix a dispersion paint. The dosing arrangement comprises a mixing vessel and one container for the aqueous paint components. Each container is connected to a dosing valve, which is arranged in the supply area of the mixing vessel, by way of a supply line. The containers for the aqueous paint components are formed by waterproof bags.

10 Claims, 1 Drawing Sheet

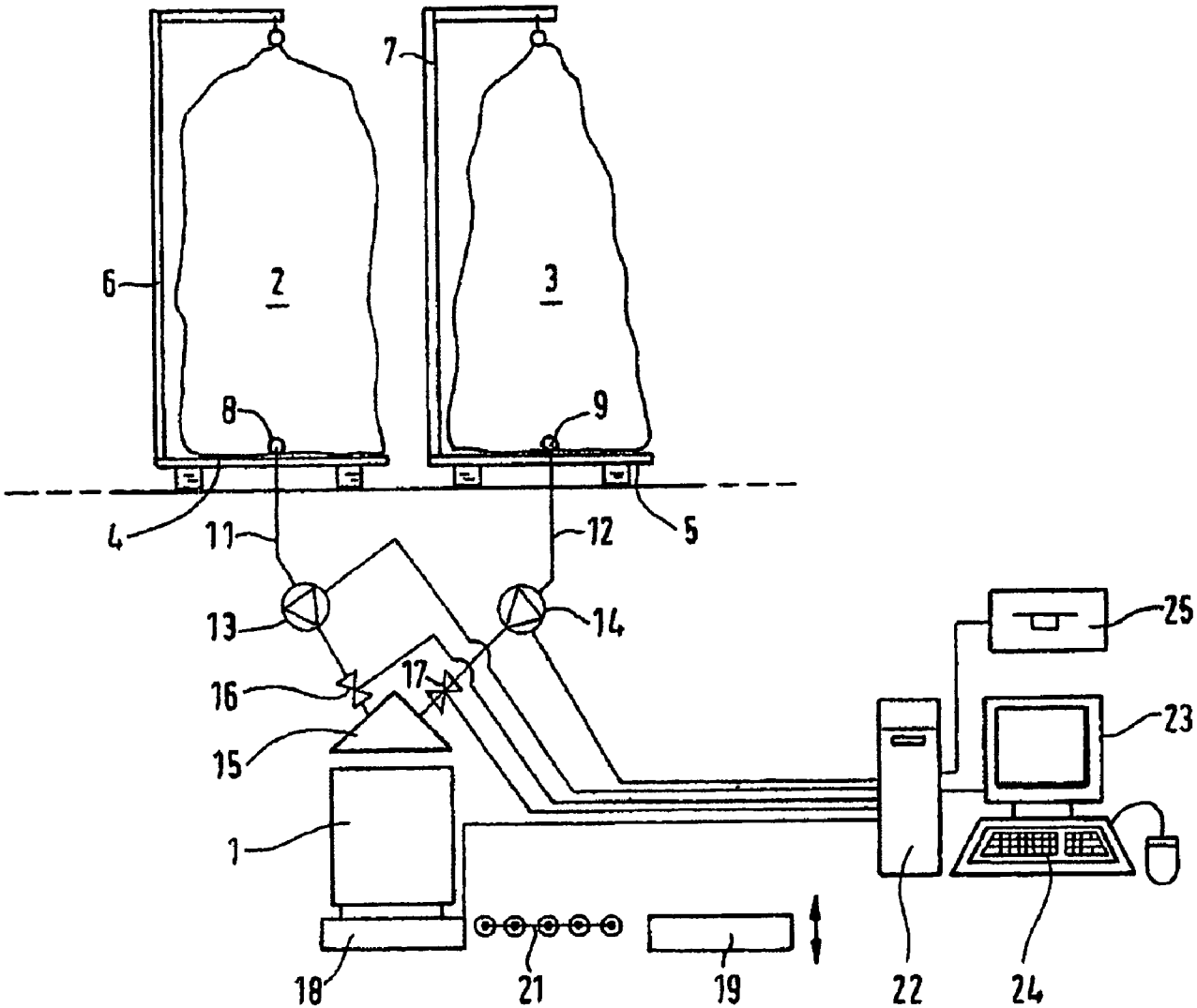
25
23
24
22
19
21
18
1
15
16
13
11
4
6
2
8
7
3
9
5
12
14
17

METERING SYSTEM FOR PREPARING EMULSION PAINTS FROM MULTIPLE AQUEOUS PAINT COMPONENTS

FIELD OF THE INVENTION

The invention relates to a metering system for mixing an emulsion paint from two or more aqueous paint components in accordance with the preamble of claim 1.

BACKGROUND OF THE INVENTION

A system of this kind is known from DE 196 54 829 A1. Containers used for the individual paint components are in that case steel tanks.

Aqueous paints which comprise fillers, pigments, polymers and the like are subject to microbial influences, such as bacterial or fungal infestation. Decomposition, discoloration, reduction in viscosity, and development of odor are the consequences. To protect paints against microbial infestation they are therefore admixed with a preservative in the tanks. Preservatives used are various biocides, examples being isothiazolines or formaldehyde donors.

In order to get as close as possible to meeting customer wishes for a particular paint composition, metering systems are set up in home improvement stores and similar points of sale for end customers. With such systems, certain paint components which are less popular may often reside in the storage tank for months. The tanks with the individual components for aqueous emulsion paints must therefore be admixed with unusually large amounts of biocides in order to allow the microbial infestation to be durably prevented. In certain countries, such as Germany, however, only relatively low maximum concentrations of biocides in paints are permitted. In these countries, therefore, metering systems for aqueous emulsion paints cannot be set up at such points of sale. In those countries, instead, a large range of emulsion paints, dispensed into buckets, must be held ready at the points of sale in order to allow at least part of the possible color range to be covered. This results in a correspondingly complex and costly stock-keeping.

It is an object of the invention to provide a metering system for mixing an emulsion paint from individual aqueous paint components in separate containers, with which there is no risk of microbial infestation of the paint components in the individual containers, even after months, without any biocide concentration or at any rate only with a very low biocide concentration.

This object is achieved in accordance with the metering system of the invention which provides for dispensing an aqueous emulsion paint in the desired composition, in buckets, to the end customers at the point of sale.

SUMMARY OF THE INVENTION

The metering system of the invention is characterized in that the containers for the individual paint components, from which the emulsion paint is mixed together for the customers, is formed by a watertight bag.

This allows microbial infestation of the aqueous paint components to be prevented. In storage tanks, indeed, the microbial infestation is primarily attributable to the gas space above the level of the liquid. This gas space leads, for example, to the drying of the paint on the inner wall. Beneath a dried-up paint layer of this kind, however, the development of the microorganisms is particularly rapid.

As a result of the containers of the invention, formed as watertight and gastight bags, for the aqueous paint components, however, it is ensured that the formation of such a gas space is prevented, since the internal volume of the container contracts on discharge in accordance with the volume of the container contents.

For this purpose the conveying line is preferably connected to the lower region of the bag. The bag may be composed of a polymeric film which shrinks as a result of the underpressure formed when the bag is discharged. It is also possible, however, to use a bag made from an elastomeric material. All that is important is that the baglike containers are watertight, gastight, and flexible.

The components dispensed in accordance with the invention into containers in the form of watertight bags are aqueous dispersions made up of the various components which can be used to form an aqueous emulsion paint. Thus it is possible, for example, for there to be one or more containers for one or more polymer dispersions, one or more containers for one or more pigment dispersions, and one or more containers for one or more filler dispersions. The number of aqueous dispersions and hence containers is selected such that the emulsion paint range can be largely covered thereby. Of course, in one container, there may also be a mixture of, for example, two components, in other words, for example, a mixture of a pigment dispersion and a filler dispersion. The mixing container is generally formed by the bucket that forms the selling can for the customer.

The amount of paint filled into the bucket is determined using a balance on which the bucket is disposed during dispensing. Beside the balance there may be a shaker provided for the homogeneous mixing of the dispensed paint. Between the balance and shaker there may be a transport apparatus located, a roller track for the bucket, for example.

In order to allow precise metering there is preferably a conveying pump provided in the conveying line between the respective container and the feed region to the bucket. The metering of the paint from the individual components is controlled by means of a control apparatus, a PC for example, the control apparatus being connected to the metering valves at the feed region to the bucket and preferably also to the conveying pumps in the conveying lines, and to the balance.

Connected to the PC is a keyboard or similar input device for controlling the metering valves and the conveying pumps for the individual paint components in accordance with the desired paint composition.

Provided on the control apparatus there may be a printer for a label to be applied to the bucket, this printer printing the data onto the label in a way which, if desired, is also machine-readable, e.g., as a barcode, for settlement at the till of the emulsion paint dispensed into the bucket, after the label has been adhered.

Computer-assisted advice and product selection give rise to a multiplicity of possible combinations. If, for example, a matt exterior paint of low hiding power is to be dispensed in the bucket, then, using the input device, a high proportion of polymer dispersions and fillers and a low proportion of pigment is set. The input device is also used to select the amount of paint to be dispensed into the bucket. Via the PC, in that case, the metering valves and conveying pumps for the individual paint components are controlled accordingly, with the metering valves being closed and the conveying pumps shut off when the amount of paint dispensed into the bucket reaches the predetermined level as measured by the balance.

In order that the baglike, flexible containers for the individual aqueous paint components can be held and fully discharged, they may be disposed in or on a frame and/or suspended by their top end. The frame in this case may be formed by a pallet having at the side a support on which the container is suspended. Moreover, the container does not need to be of fully flexible design. Instead it is conceivable for the container to be composed of a rigid material, in the form for example of a shell, in the region of the outlet opening, to which the conveying line is connected.

BRIEF DESCRIPTION OF THE DRAWINGS

The invention is illustrated below with reference to the attached drawing, whose single FIGURE shows in diagrammatic form a metering system according to one embodiment of the invention.

DETAILED DESCRIPTION

According to said FIGURE the metering system for mixing an aqueous emulsion paint has a bucket as mixing vessel 1 and two or more, five to eight for example, containers 2, 3 each for one paint component, from which the emulsion paint is mixed, only two of these containers being depicted in the drawing. The containers 2, 3, which are filled with an aqueous dispersion of the respective paint component, in other words, for example, with a polymer dispersion, a pigment dispersion or a filler dispersion, are composed in each case of a watertight bag comprising a polymeric film. The bags 2, 3, which can have a capacity of 200 to 1500 liters, for example, stand in each case on a pallet 4, 5. Each pallet 4, 5 is provided with a support 6, 7, from which the bag 2 or 3 is suspended. Each of the bags 2 or 3 is supported by a respective support pallet 4, 5 having an upward facing pallet surface on which the bag 2 or 3 stands to support the contents in a lower bag end. The pallet includes one of the upstanding supports 6 or 7 from which the bag is suspended. As can be seen, the support 6, 7 is engaged with a top bag end and maintains the bag in a vertically elongate condition during contraction of the bag and the internal bag volume during discharge of the contents. Each of the pallets 4, 5 has the support 6, 7 on one side of the support surface which extends vertically and overlies the top bag end which is suspended therefrom.

A plurality of the pallets 4, 5 are provided which are independently transportable and positioned in a stationary position during mixing, wherein each of the pallets 4, 5 supports a respective one of the bags 2, 3 thereon in the vertically elongate condition.

Each container 2, 3 has at the base an outlet opening 8, 9 to which a conveying line 11, 12 is connected, formed for example as a hose. The opening 8, 9 is disposed above the pallet surface with the conveying line 11, 12 and discharges to one side of the bag 2, 3 and the pallet 4, 5 through the conveying line 11, 12. The respective dispersion in the container 2, 3 is supplied using a pump 13, 14 in the conveying line 11, 12 to a filling head 15, which is located in the feed region above the bucket 1.

Each conveying line 11, 12 has a metering valve 16, 17 connecting it to the filling head 15. The bucket 1 is placed on a balance 18. Beside the balance 18 there is a shaker 19 and, in between them, a roller track 21.

The metering system is controlled by a PC 22 with monitor 23 and keyboard 24 or similar input device. From the PC 22 the pumps 13, 14 and the metering valves 16, 17 are driven. Furthermore, the balance 18 is connected to the PC 22.

The keyboard 24 is used to input, in accordance with the predetermined formula, the nature and amount of the paint components in the containers 2, 3 that are to be mixed together in the bucket 1, and also the amount of emulsion paint to be filled into the bucket 1. Using the PC 22, the respective pump 13 or 14 in the respective conveying line 11 or 12 is actuated and the respective metering valve 16 or 17 is open in order to supply the relevant paint components from the individual containers 2, 3, in the desired amount, via the filling head 15, to the bucket 1. As soon as the predetermined amount of emulsion paint has been filled into the bucket 1, the pumps 13, 14 are switched off and the valves 16, 17 are closed. The bucket 1 filled with the emulsion paint is then sealed with a lid and pushed on the roller track 21 to the shaker 19, in order for the paint mixture in the bucket 1 to be homogenized.

Furthermore, a printer 25 with which a label for the bucket 1 is printed is connected to the PC 22, and prints, for example, a barcode used for settlement of the purchased emulsion paint at the till of the point of sale.

The invention claimed is:

1. A metering system for preparing an emulsion paint from two or more aqueous paint components in the desired composition, having a mixing vessel with a feed region and having a container for each paint component, each container being connected via a conveying line to a filling head disposed in the feed region of the mixing vessel, each conveying line having a metering valve in the feed region, and the metering valves being connected to a control apparatus in order to control the metering of the paint components in accordance with the desired composition, comprising the improvement wherein the containers for the aqueous paint components are formed by watertight bags having a capacity of 200 liters to 1500 liters in order to protect against microbial infestation, and the internal volume of the bags contracts on discharge in accordance with the volume of the contents, the bags standing on a pallet which is provided with a support from which the bag is suspended, the conveying lines are connected to the lower region of each bag, and each conveying line being provided with a conveying pump.

2. The metering system of claim 1, characterized by a balance for weighing the mixing vessel.

3. The metering system of claim 2, characterized in that beside the balance a shaker is disposed.

4. The metering system of claim 1, characterized in that the control apparatus is provided with a printer for a label to be applied to the mixing vessel.

5. The metering system of claim 4, characterized in that the printer prints the data for settlement at the till on the label.

6. The use of the system of claim 1, for preparing and dispensing aqueous emulsion paints to end customers.

7. A metering system for preparing an emulsion paint from two or more aqueous paint components in a desired composition, said metering system comprising:

a mixing vessel having a feed region for receiving aqueous paint components in selected volumes to form said emulsion paint;

a filling head in the feed region of the mixing vessel which mixes said aqueous paint components for discharge into said mixing vessel;

a plurality of flexible bags having a capacity of 200 liters to 1500 liters which each contain a respective one of said aqueous paint components and which are watertight and gastight so as to protect against microbial infestation of said aqueous paint components, said bags having lower bag regions from which contents of said bags are discharged for conveyance to said filling head during mixing of the aqueous paint components, each said bag for each said aqueous paint component being connected respectively to a conveying line which said conveying line connects to said lower bag region and to said filling head disposed in the feed region of the mixing vessel, said bags having a variable internal bag volume wherein the internal bag volume contracts on discharge of the contents in accordance with the volume of the contents being discharged;

each said conveying line having a pump which generates an underpressure in said bag to effect discharge of said aqueous paint components from said lower bag region and contraction of said internal bag volume, and having a metering valve in the feed region which meters the selected volume of said aqueous paint components flowing to said mixing head, the metering valves being connected to a control apparatus in order to control the metering of the paint components in accordance with the desired composition; and each of said bags being supported by a respective support pallet having an upward facing pallet surface on which the bag stands to support the contents in a lower bag end, said pallet including an upstanding support from which the bag is suspended, said support being engaged with a top bag end and maintaining said bag in a vertically elongate condition during contraction of said bag and said internal bag volume during discharge of the contents.

8. The metering system of claim 7, wherein a plurality of said pallets are provided which are independently transportable and positioned in a stationary position during mixing, each of said pallets supporting a respective one of said bags thereon in said vertically elongate condition.

9. The metering system of claim 8, wherein each of said pallets has said support on one side of said support surface which extends vertically and overlies said top bag end which is suspended therefrom.

10. The metering system of claim 9, wherein said lower bag region includes an opening connected to said respective conveying line, which said opening is disposed above said pallet surface with said conveying line and discharges to one side of said bag and said pallet through said conveying line.

* * * * *